United States Patent [19]

Netzel et al.

[11] 4,095,041

[45] June 13, 1978

[54] MULTIPLE PART INSULATOR FOR FLEXIBLE GAS-INSULATED TRANSMISSION LINE CABLE

[75] Inventors: Philip C. Netzel, Milmont Park; Jonathan Z. Ponder, Lansdale, both of Pa.

[73] Assignee: Electric Power Research Institute, Palo Alto, Calif.

[21] Appl. No.: 808,707

[22] Filed: Jun. 21. 1977

[51] Int. Cl.[2] ..... H01B 9/04

[52] U.S. Cl. ..... 174/28; 138/114; 174/16 B; 174/111

[58] Field of Search ..... 174/28, 16 B, 111; 138/108, 112, 113, 114

[56] References Cited

U.S. PATENT DOCUMENTS

| | | | |
|---|---|---|---|
| 3,531,576 | 9/1970 | Hildebrand | 174/28 |
| 3,789,129 | 1/1974 | Ditscheid | 174/28 |
| 3,996,414 | 12/1976 | Artbauer et al. | 174/28 |

*Primary Examiner*—Arthur T. Grimley

*Attorney, Agent, or Firm*—Ostrolenk, Faber, Gerb & Soffen

[57] ABSTRACT

An insulator disk for supporting a flexible conductor within a flexible gas-filled outer housing consists of three identical segments which latch together to form a complete disk around the central flexible conductor of the flexible cable. The outer peripheries of the three segments form a continuous outer periphery which is pressed into engagement with the interior surface of the grounded outer housing. Each of the identical segments has an extending latch at one of their outer surface ends and a latch receiving surface at the other of their outer surface ends, wherein the extending latch of one segment latches into the latch-receiving segment of an adjacent segment.

18 Claims, 11 Drawing Figures

FIG. 6.
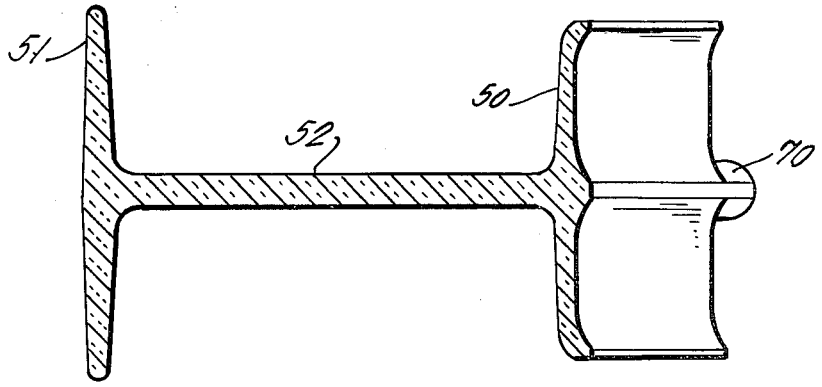
FIG. 9.
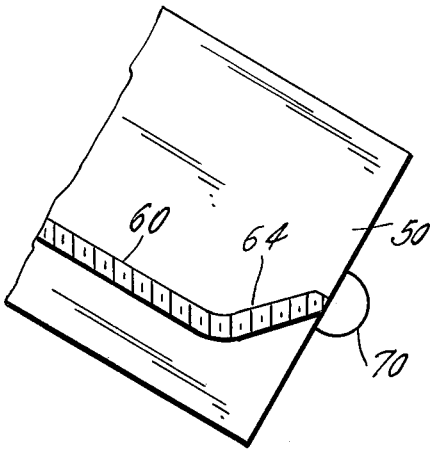
FIG. 11.
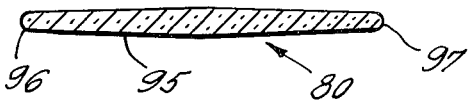
FIG. 10.
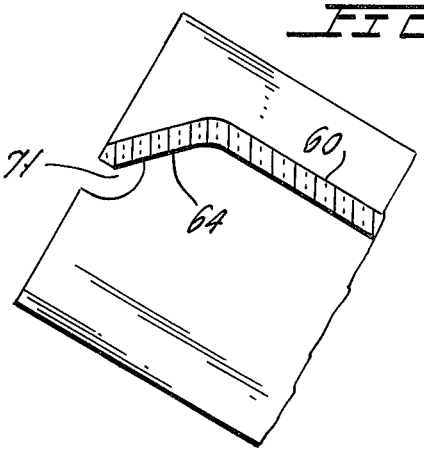
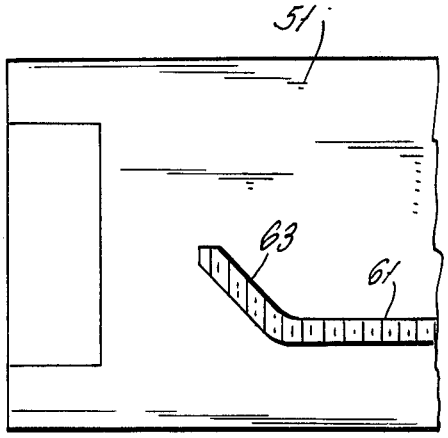
FIG. 8.

MULTIPLE PART INSULATOR FOR FLEXIBLE GAS-INSULATED TRANSMISSION LINE CABLE

RELATED APPLICATIONS

This application is related to copending applications: Ser. No. 734,965, filed Oct. 22, 1976 in the name of Philip C. Netzel and Thomas F. Brandt, entitled INSULATION SPACER FOR FLEXIBLE GAS-INSULATED TRANSMISSION LINE (C-1802 [ATG/SD]); Ser. No. 808,710, filed June 21, 1977 in the name of Philip C. Netzel, entitled IMPROVED LATCH STRUCTURE FOR INSULATOR SPACER (C-1819 [ATG/SD]); Ser. No. 808,709, filed June 21, 1977, in the name of Thomas F. Brandt, entitled OFFSET CONSTANT THICKNESS WEB FOR INSULATOR (C-1820 [ATG/SD]).

BACKGROUND OF THE INVENTION

This invention relates to a novel support insulator for flexible gas-insulated transmission line cable, and more particularly relates to a novel support insulator which consists of three identical pie-shaped segments which snap together around the outer diameter of the central cable.

Flexible gas-insulated transmission line cable is well known in the art and examples of such cable and of support insulators therefor are shown in the above related applications and are also shown in U.S. Pat. No. 3,789,129, in the name of Ditscheid, and 3,996,414, in the name of Artbauer et al.

Support insulators for flexible cable have been made of two identical halves where each of the halves has two spring-like members extending from its outer rim in order to provide a pressure fit within the enclosure housing after the housing has been corrugated. In order to form these spring members, however, it has been necessary to break the outer rim surface. This break in the outer rim tends to reduce the creepage path between the central conductor and its outer grounded enclosure and thus increases the possibility of a flash-over in this area.

A further problem with the two-piece type insulator is that each of the identical parts are relatively large members formed by an injection-molding process. Since the parts are large, shrinkage during the molding process is not always completely uniform so that the resulting molded product is distorted from its desired shape. Thus, the part tends to shrink more across its outer diametral or end surface dimension than in any other radial dimension. Consequently, the center rim of the insulator half which fits around the central conductor of the transmission line cable is narrower across the break line or outer surface than at some distance, say 90°, from the mating surfaces of the two insulator halves. At the same time, the conductor sheath of the central conductor may be out-of-round so that, in some cases, it is not possible to assemble the insulator halves on the conductor.

BRIEF DESCRIPTION OF THE PRESENT INVENTION

In accordance with the present invention, a novel insulator disk is provided which consists of three identical segments which each extends 120° around the central conductor to be supported within an outer grounded housing. These smaller sections can now be made so that the final insulator will have a smooth unbroken outer rim, with the latches which hold the three pieces assembled on the conductor being of the general type shown in copending application Ser. No. 808,710 (C-1819 [ATG/SD]). In the case of the present invention, however, the latches are also used as centering springs for holding the insulator in place within the outer conductive housing. Thus, each of the latch members may extend above the normal insulator periphery by three or four millimeters so that, when the enclosure is corrugated, these extended latch portions will be pressed down to about the same diameter as the outer periphery of the insulator. Thus, the insulator will be held within the outer conductive housing at three points by the latch spring members.

A further advantage of using these individual segments for the insulator is that these segments are relatively small as compared to the one-half circle segments used in the prior art, and they will tend to shrink in a more uniform way during molding. Consequently, each individual segment will better retain its desired configuration after the molding process. Moreover, three insulator segments can be more easily used with central conductors which are out-of-round.

BRIEF DESCRIPTION OF THE DRAWINGS

FIG. 6 is a cross-sectional view of FIG. 4 taken across the section line 6—6 in FIG. 4.

FIG. 8 is a cross-sectional view of FIG. 5 taken across the section line 8—8 in FIG. 5.

FIG. 9 is a cross-sectional view of FIG. 4 taken across the section line 9—9 in FIG. 4.

FIG. 10 is a cross-sectional view of FIG. 5 taken across the section line 10—10 in FIG. 5.

FIG. 11 is a cross sectional view of FIG. 5 taken across the section line 11—11 in FIG. 5.

DETAILED DESCRIPTION OF THE DRAWINGS

Figure 2:
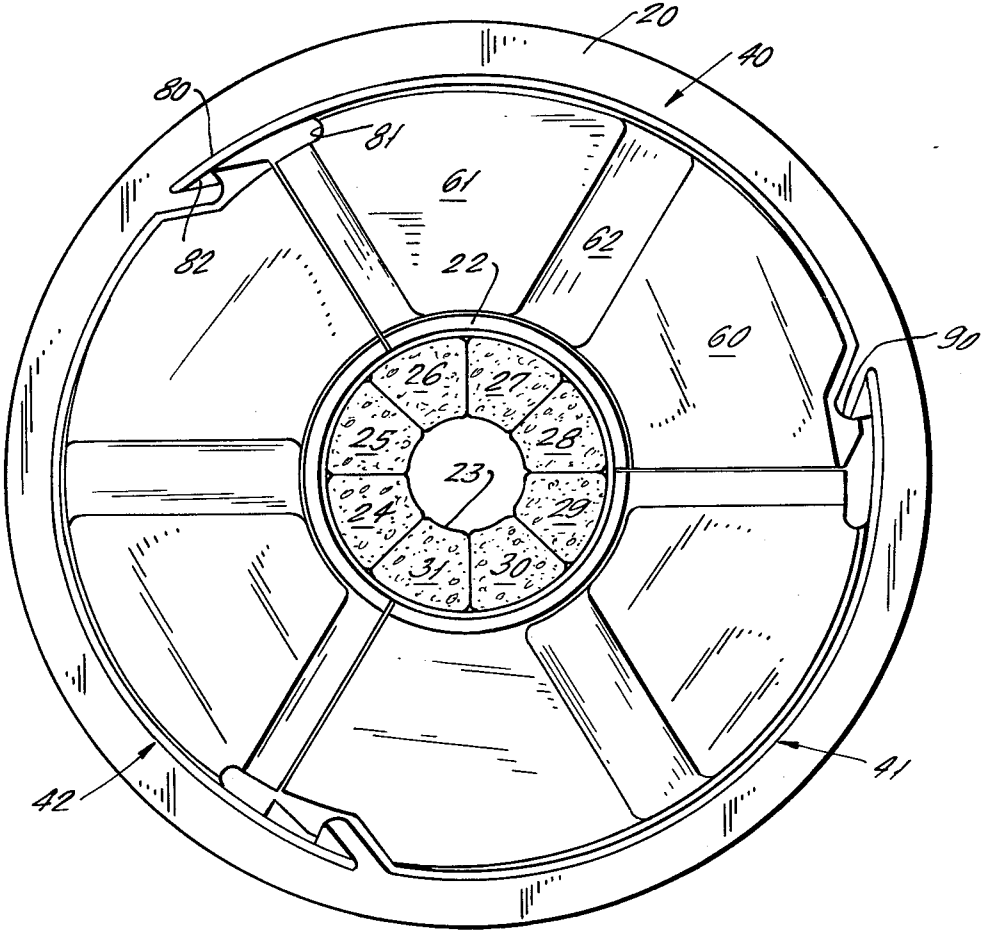
FIG. 2 is a cross-sectional view of FIG. 1 taken across the section line 2—2 in FIG. 1.
Figure 1:
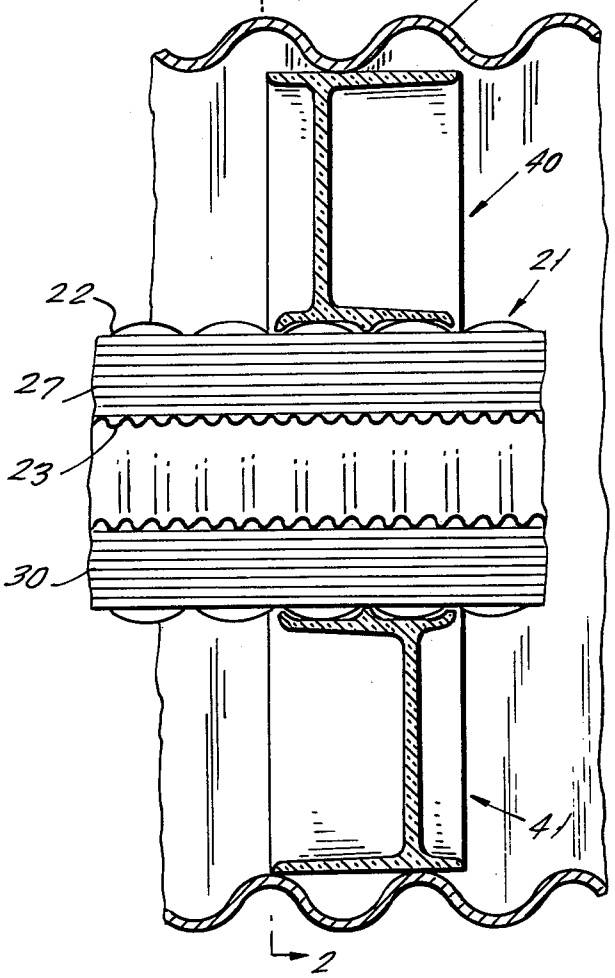
FIG. 1 is a cross-sectional view through a flexible gas-insulated transmission line cable of the type to which the invention is directed.
Figure 3:
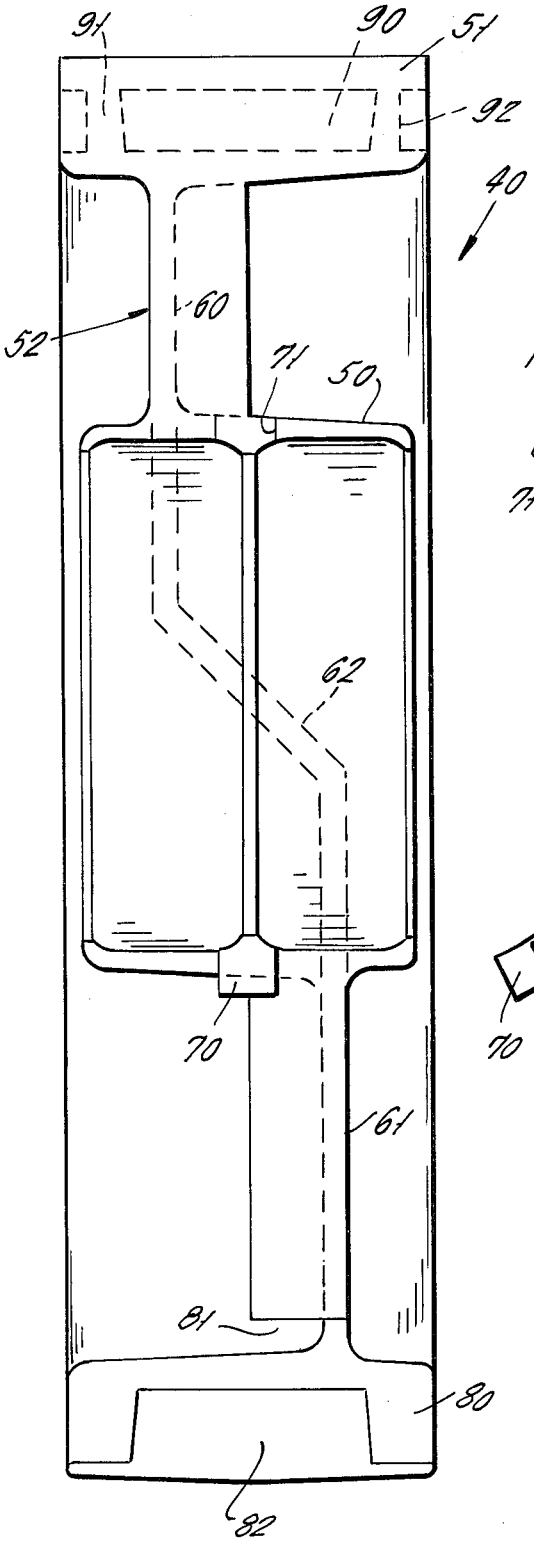
FIG. 3 is an end view of one of the three segments which makes up the insulator disk of FIGS. 1 and 2.
Figure 5:
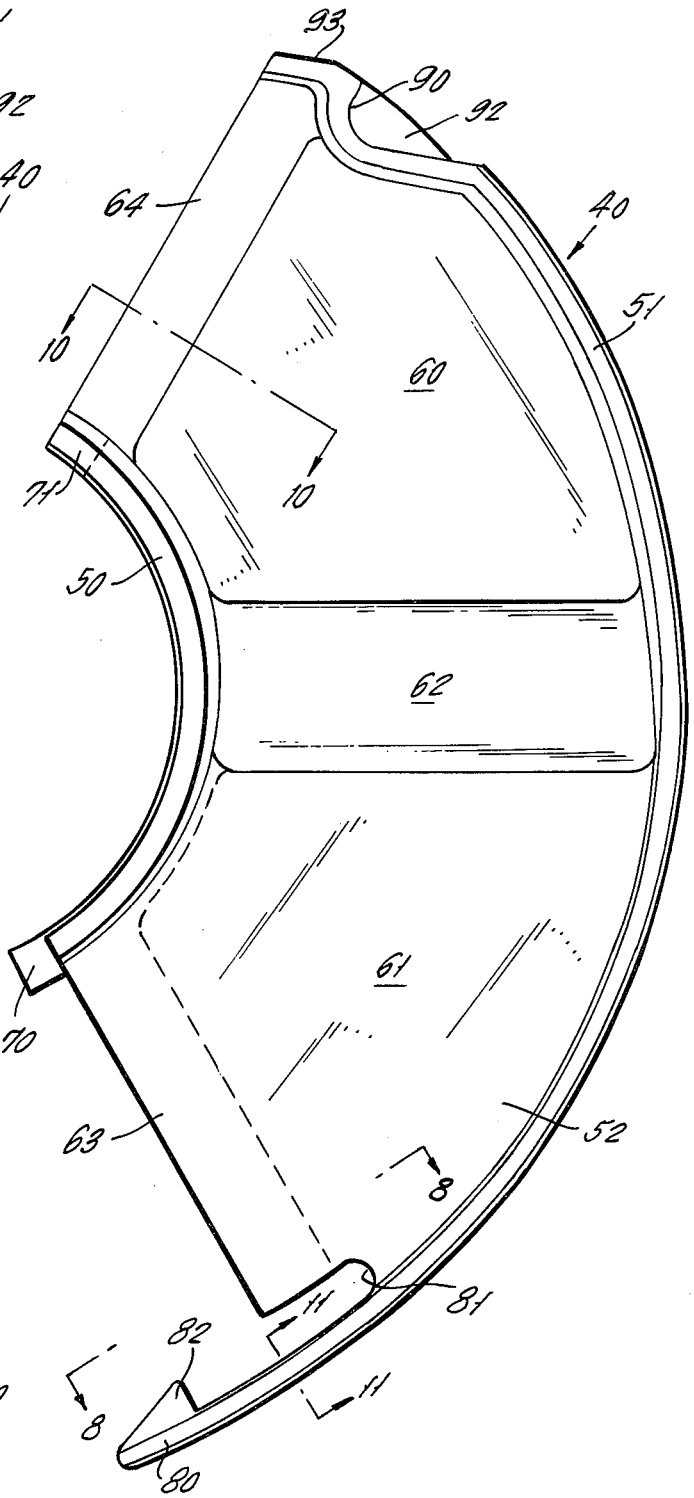
FIG. 5 is a view of the right-hand side of FIG. 3.
Figure 7:
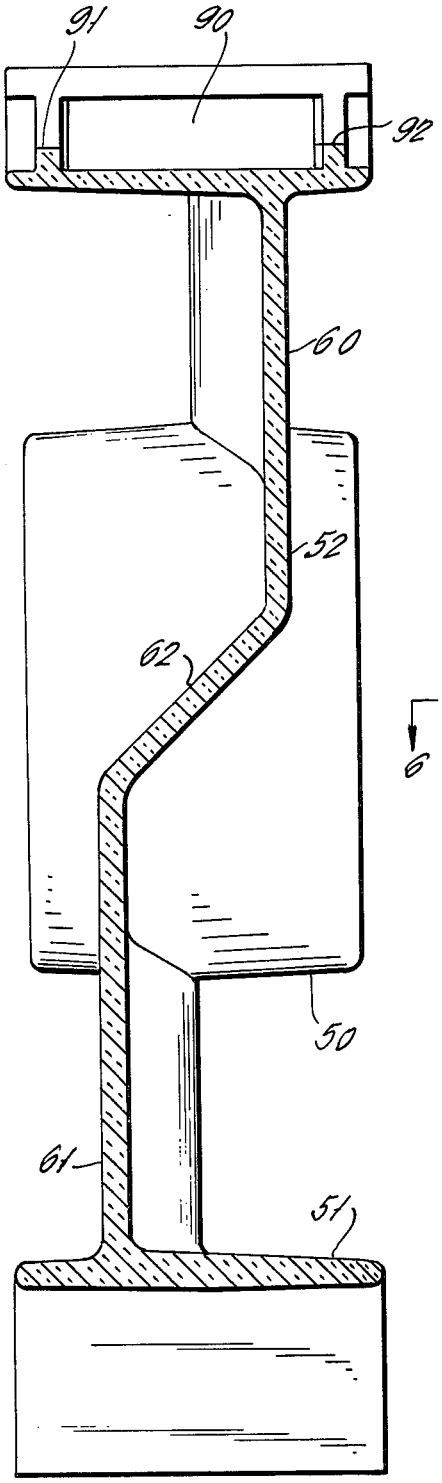
FIG. 7 is a cross-sectional view of FIG. 4 taken across the section line 7—7 in FIG. 4.
Figure 4:
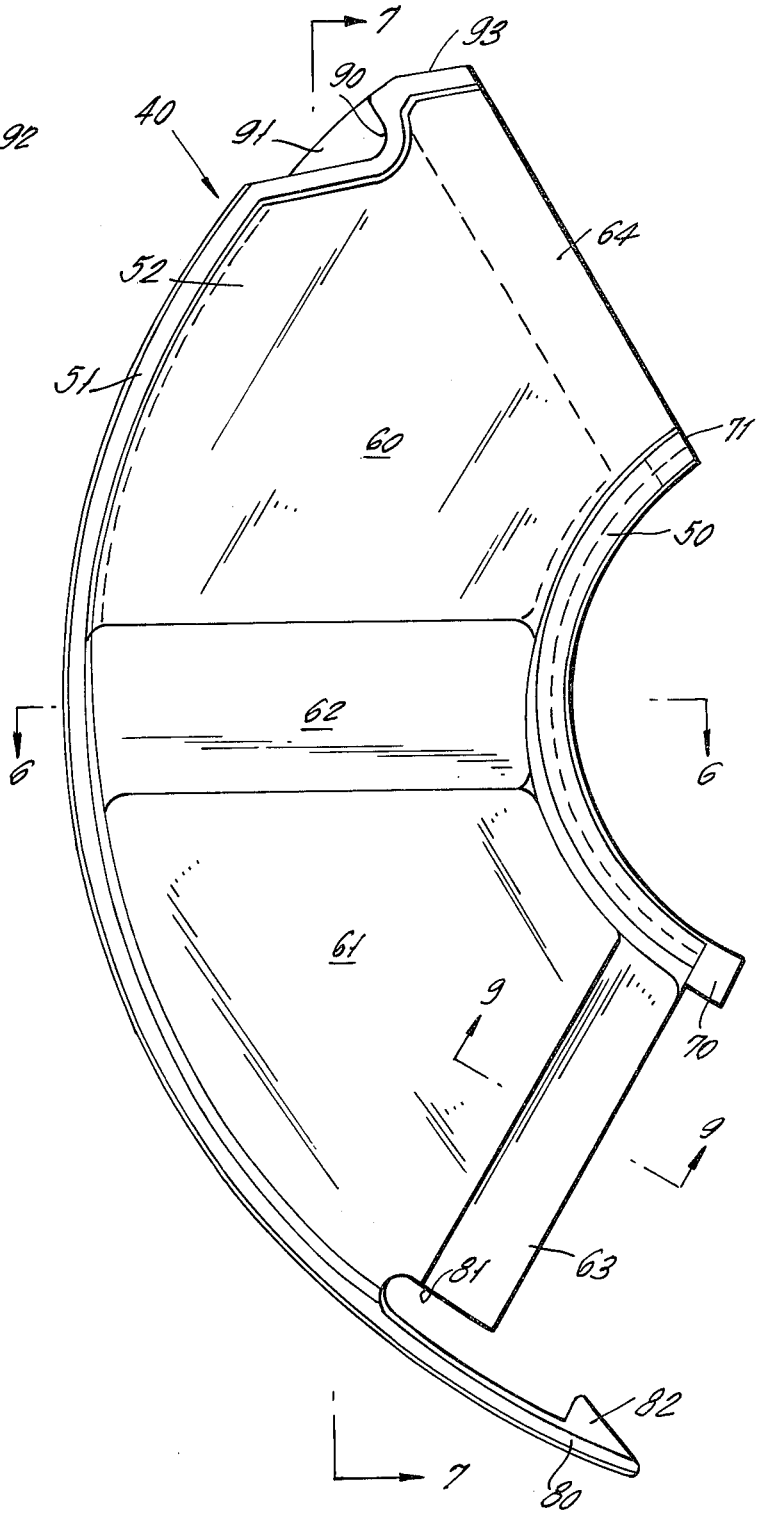
FIG. 4 is a side-view of the segment of FIG. 3 when seen from the left-hand side of FIG. 3.

Referring first to FIGS. 1 and 2, there is illustrated therein a short section of a gas-insulated flexible transmission line cable in which an outer conductive housing 20, which is corrugated as shown, encloses a central conductive cable 21 which is also constructed to be flexible. The outer diameter of flexible outer housing 20 may be about 300 mm. and the cable has a general rating and construction of that described in copending application Ser. No. 734,965 (C-1802 [ATG/SD]).

The central conductor 21 may have any desired configuration but, as shown in FIGS. 1 and 2, the configuration chosen is one using an outer corrugated conductive sheath 22 and a central conductive corrugated sheath 23, with a plurality of stranded conductors formed in trapezoidal segments 24 to 31 contained between sheaths 22 and 23.

The conductive housing 20 is gas-tight and is filled with a suitable insulation gas such as sulfur hexafluoride under a positive pressure of about three atmospheres. A plurality of axially spaced support insulators is then provided to support central conductor 21 within the outer housing 20. These support insulators must permit flexing of the transmission line in order to permit the line to be reeled for shipment and to be unreeled during installation, and to permit the line to follow any desired contour when the line is installed.

FIGS. 1 and 2 illustrate the novel support insulator of the present invention which consists of three identical segments 40, 41 and 42 which are each 120° pie-shaped segments which support conductor 21 relative to the outer housing 20. FIGS. 5 to 11 show the details of the construction of insulator segment 40.

Referring to FIGS. 3 to 11, it will be seen that typical insulator segment 40 consists of a central rim 50, an outer rim 51 and a thin uniform web 52 which joins the inner rim 50 to the outer rim 51. As shown in FIG. 6, the inner periphery of the central hub is contoured so that it will conform to the outer corrugations 22 of the flexible conductor 21, as shown in FIG. 1.

The web 52 is constructed in the manner disclosed in copending application Ser. No. 808,709, (C-1820 [ATG/SD]), in that it has a uniform thickness but has offset web sections 60 and 61 which extend in different parallel planes and which are joined by joining web section 62 in order to increase the stiffness modulus of the insulator disk. Note that the end portion of sections 60 and 61 also bend out of the plane of the insulator as shown for sections 63 (FIG. 8) and 64 (FIG. 9), where they will extend continuously with corresponding sections of adjacent segments 41 and 42 to continue the structural strength of the support web. The web 52 is relatively thin and of constant thickness to improve the dielectric characteristics of the insulator, and to improve the ability to mold the insulator without defects.

In order to lock the hub sections 50 of each adjacent insulator section relative to one another, the hubs 50 are each provided with a projecting key member 70 at one end and a keying depression 71 at their other end. The key 70 of one segment will enter the keying depression 71 of an adjacent element to insure axial strength and axial locking of the segments relative to one another when they are assembled on the central conductor.

The outer rim 51 of the segment is provided with latching members for latching adjacent sections together. Thus, one end of outer rim 51 has an extending latch member portion 80, which is made to be flexible, by forming a notch 81 in portions 61 and 63 of the support web 52. Latch portion member 80 has an inwardly extending latching projection 82 which is located centrally within the end member 80. The opposite end of rim 51 is provided with a latch-receiving depression 90 which is disposed centrally between reinforcing ribs 91 and 92. A camming surface 93 is provided in front of depression 90. Thus, as shown in FIG. 2, when the segments are to be assembled relative to one another, the latch portion 80 of one insulator is forced over the camming surface portion 93 of the adjacent insulator so that the latch projection 82 raises up, and then snaps into latch depression 90 of the adjacent insulator, thereby firmly to hold the insulator segments in position relative to one another around the central conductor.

The extending latch portion member 80 extends slightly above the circular periphery of the rim 51 and may extend about 3 or 4 mm. thereabove when the rim 51 is unstressed. Consequently, the member 80 serves as a spring-type member which bears against the inner periphery of housing 20 in FIGS. 1 and 2, when the housing is formed around the central cable thereby to securely hold the assembled disk insulator in place within the central conductor by three spring portions defined by the three extending latch portion members 80, respectively, of each of the segments.

In order to strengthen the spring characteristics of portion 80, the thickness at the center of portion 80, designated by numeral 95 in FIG. 11, is made thicker than at the edges 96 and 97 of portion 80.

The insulator structure described above may be formed of any desired insulation material and a preferred insulator has been phenylene oxide.

The individual segments which each enclose 120° of the area around the central conductor of the flexible cable are more easily molded than are 180° segments and they exhibit more uniform shrink characteristics. Moreover, the use of three individual segments has allowed the use of the insulators on a central conductor which may be somewhat out-of-round. The insulator structure has the desired web stiffness advantages of the insulator described in copending application Ser. No. 808,709, (C-1820 [ATG/SD]) and further prevents a direct line-of-sight from the central conductor to the outer housing, since the latch used is the central type latch of the form shown in copending application Ser. No. 808,710, (C-1819 [ATG/SD]).

Although a preferred embodiment of this invention has been described, many variations and modifications will now be apparent to those skilled in the art, and it is therefore preferred that the instant invention be limited not by the specific disclosure herein but only by the appended claims.

The embodiments of the invention in which an exclusive privilege or property is claimed are defined as follows:

1. An insulator support disk for supporting the central conductor of a gas-insulated transmission line within an outer grounded housing which is coextensive with said central conductor; said insulator support disk consisting of a plurality of identical pie-shaped segments, each extending over an angle less than 180° around said central conductor, and each having a central axial extending rim for gripping the central conductor of a transmission line, an axially extending outer rim for gripping the interior of the housing of a transmission line, and a central web extending between said outer rim and said central rim, and means for securing said plurality of segments to one another to define a continuous support disk.

2. The insulator support disk of claim 1 wherein said support disk is adapted for installation in a flexible gas-insulated transmission line having a corrugated central conductor and corrugated outer housing.

3. The insulator support disk of claim 1 wherein said support disk consists of three identical pie-shaped segments which each have side edges at an angle of 120° with respect to one another.

4. The insulator support disk of claim 1 wherein each of said central rims has a keying extension and corresponding keying depression at the opposite ends of said central rim respectively; the said keying extension of said central rim of one of said plurality of segments fitting into said keying depression of the said central rim of an adjacent one of said plurality of segments when said plurality of segments are assembled into a continuous disk.

5. The insulator support disk of claim 4 wherein said support disk consists of three identical pie-shaped segments which each have side edges at an angle of 120° with respect to one another.

6. The insulator support disk of claim 1 wherein said outer rim of each said segments is a smooth and unbroken cylindrical section.

7. The insulator support disk of claim 1 wherein the outer rim of each of said segments includes an integral projecting latch member extending from one end which has spring-type characteristics, and a latch-receiving depression in the outer surface of said outer rim at the end opposite from said one end; said projecting latch member of one of said segments engaging and latching into said latch-receiving depression of an adjacent one of said segments, thereby to latch each of said segments into a single disk, and defining said means for securing said plurality of segments to one another.

8. The insulator support disk of claim 7 wherein said projecting latch member is centered over the width of said outer rim.

9. The insulator support disk of claim 7 wherein said projecting latch members extend slightly above the circular periphery defined by said outer rim when said projecting latch members are unstressed.

10. The insulator support disk of claim 9 wherein said outer rim of each of said segments is a smooth and unbroken cylindrical section.

11. The insulator support disk of claim 7 wherein each of said central rims has a keying extension and corresponding keying depression at the opposite ends of said central rim respectively; the said keying extension of said central rim of one of said plurality of segments fitting into said keying depression of the said central rim of an adjacent one of said plurality of segments when said plurality of segments are assembled into a continuous disk.

12. The insulator support disk of claim 10 wherein each of said central rims has a keying extension and corresponding keying depression at the opposite ends of said central rim respectively; the said keying extension of said central rim of one of said plurality of segments fitting into said keying depression of the said central rim of an adjacent one of said plurality of segments when said plurality of segments are assembled into a continuous disk.

13. The insulator support disk of claim 12 wherein said support disk consists of three identical pie-shaped segments which each have side edges at an angle of 120° with respect to one another.

14. The insulator support disk of claim 1 wherein said central web for each of said segments consists of at least first and second sections, axially offset relative to one another, thereby to increase the stiffness modulus of said central web; said central web having a uniform thickness.

15. The insulator support disk of claim 7 wherein said central web for each of said segments consists of at least first and second sections, axially offset relative to one another, thereby to increase the stiffness modulus of said central web; said central web having a uniform thickness.

16. The insulator support disk of claim 11, wherein said central web for each of said segments consists of at least first and second sections, axially offset relative to one another, thereby to increase the stiffness modulus of said central web; said central web having a uniform thickness.

17. The insulator support disk of claim 13 wherein said central web for each of said segments consists of at least first and second sections, axially offset relative to one another, thereby to increase the stiffness modulus of said central web; said central web having a uniform thickness.

18. The insulator support disk of claim 14 wherein said first and second sections are generally pie-shaped sections.

* * * * *